United States Patent [19]

Jacobson et al.

[11] 4,175,788

[45] Nov. 27, 1979

[54] PAVEMENT CUTTING MACHINE

[75] Inventors: Carl C. Jacobson, Tempe; Gaius P. Crosby, Mesa, both of Ariz.

[73] Assignee: Crafco, Inc., Phoenix, Ariz.

[21] Appl. No.: 894,923

[22] Filed: Apr. 10, 1978

[51] Int. Cl.[2] ..... E01C 23/09

[52] U.S. Cl. ..... 299/1; 299/39

[58] Field of Search ..... 299/1, 39

[56] References Cited

U.S. PATENT DOCUMENTS

| | | | |
|---|---|---|---|
| 2,736,544 | 2/1956 | Wright | 299/39 |
| 2,934,327 | 4/1960 | Lewis | 299/39 |
| 3,063,690 | 11/1962 | Cornell | 299/39 |
| 3,663,060 | 5/1972 | Shatwell et al. | 299/39 |

*Primary Examiner*—Ernest R. Purser

*Attorney, Agent, or Firm*—Herbert E. Haynes, Jr.

[57] ABSTRACT

A machine for opening the joints and random cracks in pavement preparatory to placement of a filler-sealer material therein. The machine includes an open carriage having an opposed pair of side wheels and a shroud mounted in the carriage intermediate the side wheels. A cutter wheel is journaled in the shroud for rotation about a horizontal axis, and the cutter wheel is driven by an engine mounted atop the shroud. The shroud is pivotably coupled to the carriage for raising and lowering of the cutter wheel by moving the axis of the cutter wheel in an arc which passes through the axis of the carriage wheels.

11 Claims, 7 Drawing Figures

PAVEMENT CUTTING MACHINE

BACKGROUND OF THE INVENTION

1. Field of the Invention

This invention relates to cutting machines and more particularly to a machine for opening the joints and random cracks in pavement preparatory to the insertion of a filler-sealant material therein.

2. Description of the Prior Art

Large expanses of concrete or asphalt paved surfaces such as roadways, airport runways, and the like, often develop random cracks during curing and after periods of extended usage. Such cracks should be sealed to prevent further spreading and the general deterioration of the paved surface, and to insure safe usage of the surface. In addition to sealing of random cracks, proper maintenance of paved surfaces is ideally accomplished by periodically replacing the sealing materials in expansion joints of the pavement. To prepare a paved surface for sealing of random cracks and resealing of expansion joints, the cracks and joints are opened and cleaned so that the filler-sealant, such as asphalt, can properly enter into and firmly adhere to the sides of the cracks and joints.

Several types of machines have been used to open and clean the cracks and joints in paved surfaces, and in general, these prior art machines are very slow and extremely difficult for an operator to manipulate and otherwise control.

A first general type of prior art machine includes a large flat carriage frame having wheels at each of the corners thereof. A suitable gas operated engine is mounted on the carriage and is coupled such as by a belt or chain, to drive a rotary cutter such as a cutter wheel or saw. The rotary cutter is carried in a suitable linkage which allows raising and lowering of the cutter. This type of machine is adequate for opening and cleaning of expansion joints in that such joints are in a straight line. When it comes to opening and cleaning random cracks, this type of machine is inadequate due to the lack of maneuverability which means that it is virtually impossible to follow a random path without producing excessive widening of the crack at each point where the path changes direction.

Another prior art machine, as shown in U.S. Pat. No. 3,663,060 includes a carriage having a rearwardly disposed oppositely mounted pair of wheels and a swivel wheel on the front of the carriage. A frame is pivotably mounted on the carriage for supporting an engine which drives a circular saw that is rotatably journaled on the frame and is laterally offset between the side rails of the carriage. The circular saw is disposed on the pivotable frame so that its axis of rotation lies between the rear wheels of the carriage, and pivotable movement of the frame will cause that axis of the circular saw to move in an arcuate path that passes through the axis of the rear wheels of the carriage. With regard to the maneuverability, this prior art machine is a substantial improvement. However, some problems still exist. The laterally offset disposition of the circular saw between the side rails of the carriage is not ideal in that the arcuate path, or turning radius, that the saw follows when the machine is turned in one direction is different from the path followed when the machine is turned in the opposite direction. Also, it is extremely difficult, if not impossible, to turn the machine about a stationary vertical axis that passes through the center of the circular saw due to the laterally offset disposition thereof which results in a tendency for the vertical axis to move as a result of the wheels revolving at different rates when the machine is trying to be turned about such an offset axis.

The above described prior art machines, and all others to the best of our knowledge, have other problems and shortcomings arising from the direction in which such machines are pushed or guided by the operator. An operator will stand behind the machine and push it along the path of the joint or crack. This means that it is physically impossible for the operator to see the crack or joint immediately in front of the cutting saw or wheel in that his view is obstructed for at least a foot or two in front of the cutting saw by the machine itself, and he must try to look through a cloud of dust and pavement chips which are being ejected forwardly of the machine. Another problem in these prior art machines, is that pushing of the machine as described above, will quickly tire an operator as such pushing motion must be accomplished against the tendency of the machine to propel itself rearwardly. Such a tendency results from the biting action and frictional engagement of the rotary cutter with the concrete, and the direction of this self-propelling tendency is dictated by the rotational direction of the rotary cutter which cannot be reversed in that the dust and pavement chips must be propelled away from the operator, i.e., forwardly of the machine.

Therefore, a need exists for a new and improved pavement cutting machine which overcomes some of the problems and shortcomings of the prior art.

SUMMARY OF THE INVENTION

In accordance with the present invention, a new and improved machine is disclosed for opening and cleaning expansion joints and random cracks in pavement preparatory to the filling and sealing thereof.

The machine includes an open carriage having an opposed pair of side wheels and a shroud mounted thereon. A cutter wheel is journaled in the shroud for rotation about a horizontal axis and is driven by an engine mounted atop the shroud. The shroud is pivotably mounted on the carriage so that the engine and cutter wheel can be raised and lowered, by a suitable power actuator means, relative to the frame to provide adjustable pavement cutting depths and for raising the cutter wheel above the pavement to a noncutting position. The cutter wheel is positioned intermediate the carriage wheels, and its rotational axis is located so that it will lie on or near the carriage wheel axis, as determined by the pivotal position of the shroud. This specific arrangement of the components allows precision maneuverability and ease of handling so that an operator can rapidly and accurately follow the most intricate path of a random crack.

The machine is designed so that an operator, will, in effect, pull the machine toward him rather than push it which results in improved operator visibility as compared to prior art machines, in that the present machine will not obstruct his view and he will not be required to look through a cloud of dust and pavement chips. Further, this operational mode takes advantage of the machine's natural tendency to propel itself rearwardly so that the machine is self-propelling and all that an operator must do is guide the machine. When the machine is set to make a relatively deep cut and/or is operating in hard paving material, the rearwardly exerted self-propelling force of the machine is quite strong, thus, to give the operator positive control of the machine and to prevent the possibility of the machine running away, it is provided with an adjustable automatic braking mechanism.

The machine is provided with a unique depth adjustment gage which allows the operator to rapidly and accurately set the machine's cutting depth in a manner which will automatically compensate for normal wear on the cutting elements of the cutter wheel.

Accordingly, it is an object of the present invention to provide a new and improved machine for cutting pavement.

Another object of the present invention is to provide a new and improved machine for opening and cleaning expansion joints and random cracks in pavement preparatory to the filling and sealing thereof.

Another object of the present invention is to provide a new and improved machine of the above described character having the components thereof arranged in a particular configuration to provide the machine with the characteristics of precision maneuverability and ease of handling.

Another object of the present invention is to provide a new and improved machine of the above described type which is designed to be pulled by an operator to take advantage of the natural tendency of the machine to propel itself rearwardly and to improve the operator's view of the pavement area that the machine is cutting.

Still another object of the present invention is to provide a new and improved machine of the above described type which is provided with an adjustable automatic braking mechanism to provide positive operator control of the machine.

Yet another object of the present invention is to provide a new and improved machine of the above described type which is provided with a depth adjustment gage means by which the machine may be rapidly and accurately adjusted to a desired cutting depth and will automatically compensate for wear on the cutting elements of the machine.

The foregoing and other objects of the invention as well as the invention itself, may be more fully understood from the following description when read in conjunction with the accompanying drawings.

DESCRIPTION OF THE PREFERRED EMBODIMENT

Figure 1:
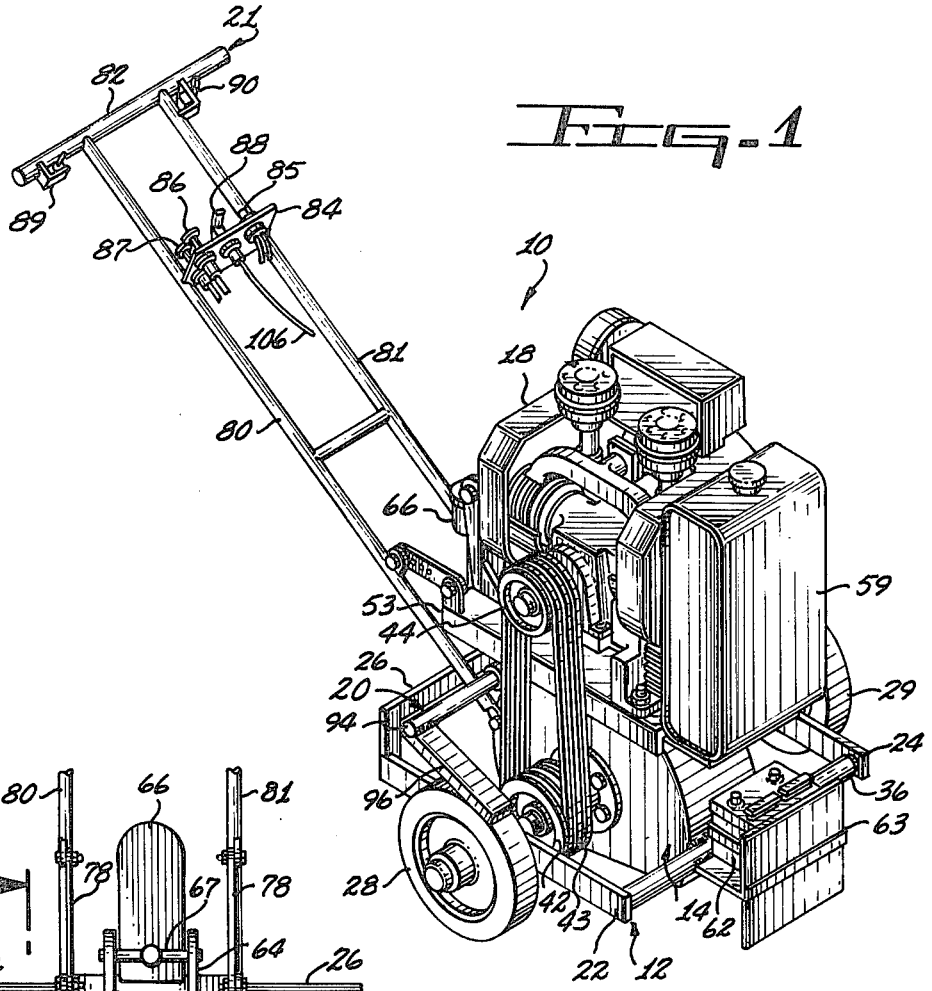
FIG. 1 is an isometric view of the pavement cutting machine of the present invention.

Referring more particularly to the drawings, FIG. 1 shows the pavement cutting machine of the present invention which is indicated in its entirety by the reference numeral 10.

As will hereinafter be described in detail, the machine 10 includes the basic components of a wheeled carriage 12, a shroud 14 pivotably mounted in the carriage, a cutter wheel 16 rotatably journaled in the shroud, an engine 18 mounted atop the shroud, an adjustable automatic brake assembly 20, and a handle assembly 21 by which an operator can guide and control the various functions of the machine 10.

Figure 2:
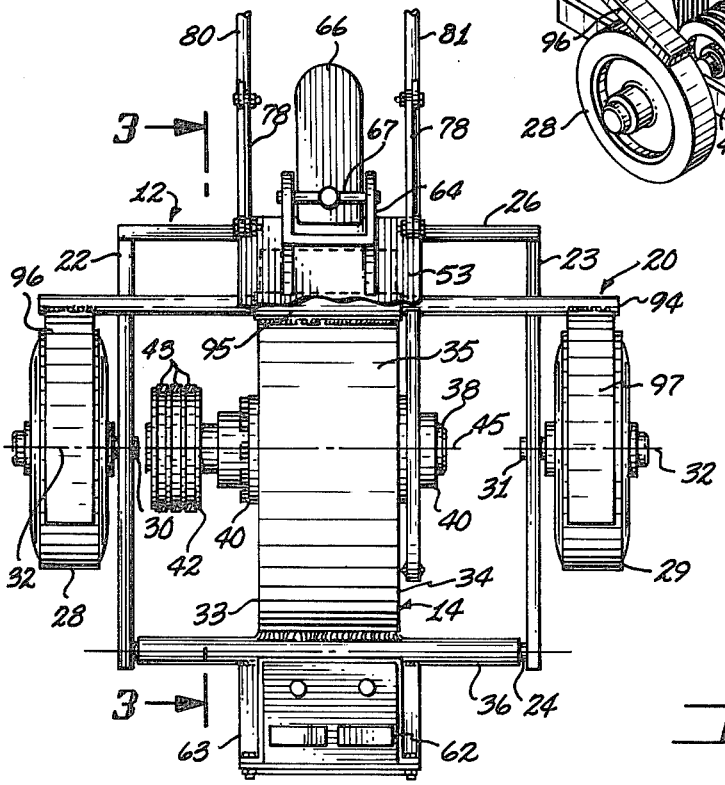
FIG. 2 is an enlarged fragmentary plan view of the machine of the present invention which is broken away to illustrate the various features thereof.

The carriage 12 is of substantially square open configuration having a spaced pair of side rails 22 and 23 which are connected, as will hereinafter be described, at their forwardly aligned front ends with a front cross bar 24 which is round in cross section, and are connected at their rearwardly aligned ends with an upwardly offset rear cross rail 26. The carriage 12 is provided with an opposed pair of wheels 28 and 29 which are suitably journaled so as to be freely rotatable on stub axles 30 and 31 which extend oppositely from different ones of the side rails 22 and 23 with those stub axles being located intermediate the opposite ends of their respective side rails. Thus, the wheels 28 and 29 are centrally disposed with respect to the carriage 12 and will rotate about a common wheel axis 32 which is defined by the axially aligned stub axles 30 and 31 as seen in FIG. 2.

Figure 3:
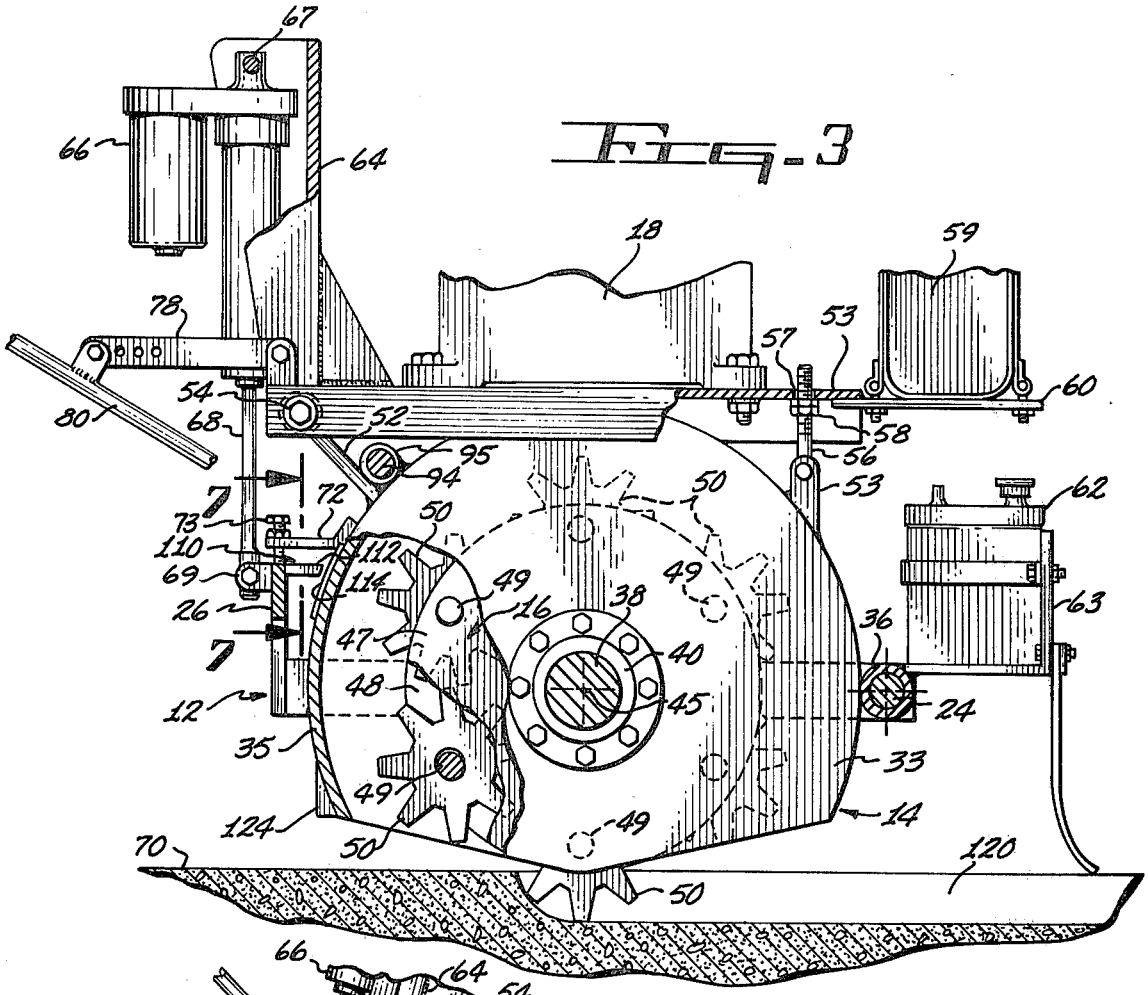
FIG. 3 is an enlarged fragmentary sectional view taken along the line 3—3 of FIG. 2, with this Figure being broken away to show the various features and showing the machine in the pavement cutting position thereof.

The shroud 14, as seen in FIG. 3, is a downwardly opening structure having a spaced pair of side plates 33 and 34 which are interconnected by a transverse arcuately shaped plate 35. A tubular sleeve 36 is transversely affixed to the forward end of the shroud 14, such as by welding, with the round bar 24 of the carriage 12 passing through the tubular sleeve 36. Thus, the bar 24 serves as a pivot axle with the sleeve 36 providing means by which the shroud 14 is pivotably movable about the pivot axle. The tubular sleeve 36 is an elongated member which is slightly shorter in length than the round bar 24 so as to center the shroud 14, and thus the cutter wheel 16 as will be explained, at a location intermediate the carriage wheels 28 and 29.

The cutter wheel 16 is disposed in the shroud 14 and is fixedly mounted for rotation with an arbor 38 that is rotatably journaled in a pair of suitable bearings 40 that are aligningly carried in different ones of the spaced side plates 33 and 34 of the shroud 14. The arbor 38 has a pulley 42 fixedly mounted to an extending end thereof and drive belts 43 couple that pulley 42 with a similar pulley 44 carried on the output shaft of the engine 18 as shown in FIG. 1.

The arbor 38 defines a horizontally disposed rotational axis 45 about which the cutter wheel 16 is rotatably drivable, and that rotational axis will lie on or near the carriage wheel axis 32 as determined by the pivotal position of the shroud 14. This particular relationship of the rotational axis 45 with the wheel axis 32, in conjunction with the central positioning of the cutter wheel 16 between the carriage wheels 28 and 29 provides the machine 10 with exceptional maneuverability and handling characteristics as will hereinafter be described in detail.

It is to be understood that any suitable type of cutter wheel may be employed in the machine 10, however, the specific type of cutter wheel 16 shown in FIG. 3 is preferred. The wheel 16 includes a spaced pair of discs 47 and 48 which, although not shown, are to be understood as being fixedly connected to the arbor 38, with such affixation being accomplished in any well known manner. The discs 47 and 48 carry a plurality of pins 49 which are disposed in equally spaced increments adjacent the perimeters of the discs.

A plurality of impact, or cutting elements 50 are carried on the pins 49, with their being at least one element 50 carried on each of the pins. The cutting elements 50 are preferrably in the form of toothed wheels, or gears, and are loosely carried on their respective pins.

As seen best in FIG. 3, the machine 10 includes means for adjustably mounting the engine 18 on the shroud 14 to provide means for adjusting the tension of the drive means in the form of the belts 43 which interconnect the engine with the cutter wheel means as previously described. Adjustable mounting of the engine 18 is accomplished by providing a bracket 52 which extends radially from the shroud 14 and the rearwardly extending end of an engine platform 53 is pivotably secured thereon such as at 54. The platform 53 extends forwardly from the pivot connection 54 so as to be above and substantially tangentially disposed with respect to the arcuate plate 35 of the shroud 14. Means for adjusting the pivotal position of the engine platform 53 is provided by an upwardly opening clevis 55 carried on the forward end of the shroud and a bolt 56 that is pivotably carried in the clevis. The bolt 56 extends upwardly through an aperture 57 formed through the platform 53 and is provided with jam nuts 58 thereon. Threaded movement of the jam nuts 58 will cause the engine platform 53 to be pivotally moved about the pivot connection 54 and such movement is employed to adjust the tension on the drive belts 43.

The engine 18 is a standard article of commerce and it will be understood that any suitable engine can be employed. The engine 18 is mounted on the platform 53 in the conventional manner, and is equipped with a fuel tank 59 that is carried on a plate 60 which extends forwardly from the platform 53.

Electric power for the engine 18, and other functions of the machine 10 as will become apparent as this description progresses, is supplied by a suitable battery 62 that is carried on a plate 63 which is affixed to the tubular sleeve 36 of the shroud, such as by welding, and is disposed to extend forwardly of the machine 10.

At the rearwardly disposed end of the engine platform 53, an upwardly extending clevis shaped bracket 64 is provided. A suitable linear actuator 66, which in the preferred embodiment is an electromechanical device, is connected at its upper end to a pivot pin 67 carried in the bracket 64. The actuator 66 depends from the pivot pin 67 and has its output shaft 68 pivotably secured to a clevis 69 carried on the rear cross member or rail 26 of the carriage 12.

When the actuator 66 is moved toward its retracted position, as shown in FIG. 3, the shroud 14 and all the mechanisms attached thereto will be pivotably moved downwardly between the side rails 22 and 24 of the carriage into the pavement cutting or working position. By moving the actuator 66 to its extended position, as shown in FIG. 4, the shroud 14 and attached mechanisms will be moved upwardly into its nonworking position.

When the machine 10 is moved into its working position as described above, it is important that only the cutting elements 50 of the cutter wheel 16 be allowed to engage the paved surface 70 (FIG. 3). If the side plates 47 and 48 of the cutter wheel 16 are allowed to engage the paved surface, they may be severely damaged and replacement of the entire cutter wheel 16 will be needed. Thus, a positive stop mechanism is provided to limit the downward movement of the shroud 14. The stop mechanism is in the form of a bracket 72 which extends rearwardly from the shroud 14 and the bracket carries an adjustable stop bolt 73 which moves into engagement with the rear cross member 26 of the carriage when the shroud 14 has been pivotably moved to a maximum safe limit.

Figure 4:
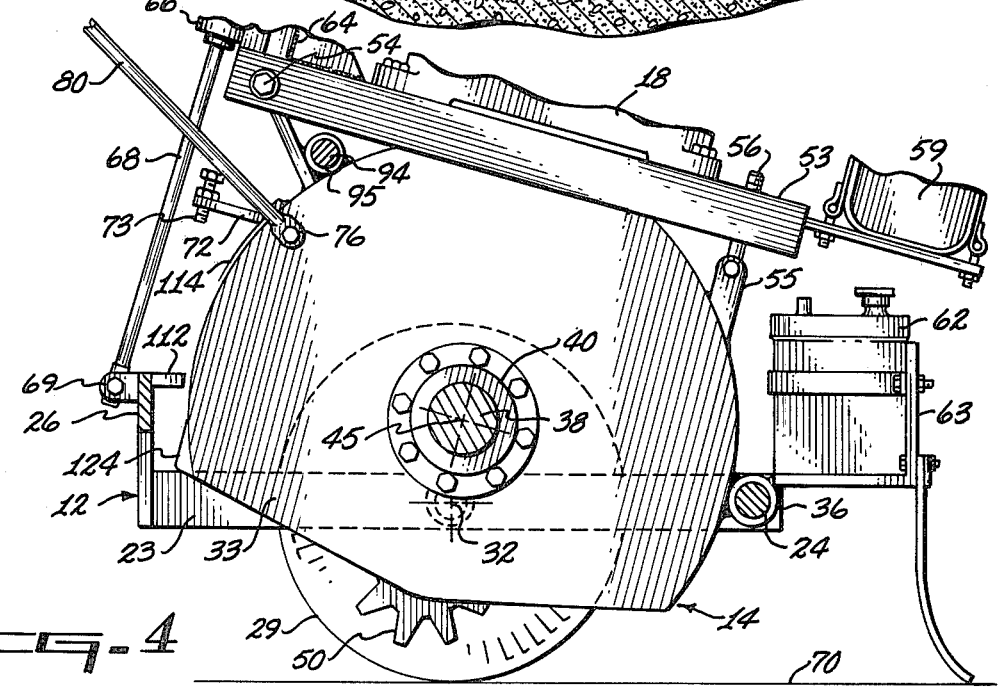
FIG. 4 is a view similar to FIG. 3 but showing the machine in its disengaged or nonpavement cutting position.
Figure 5:
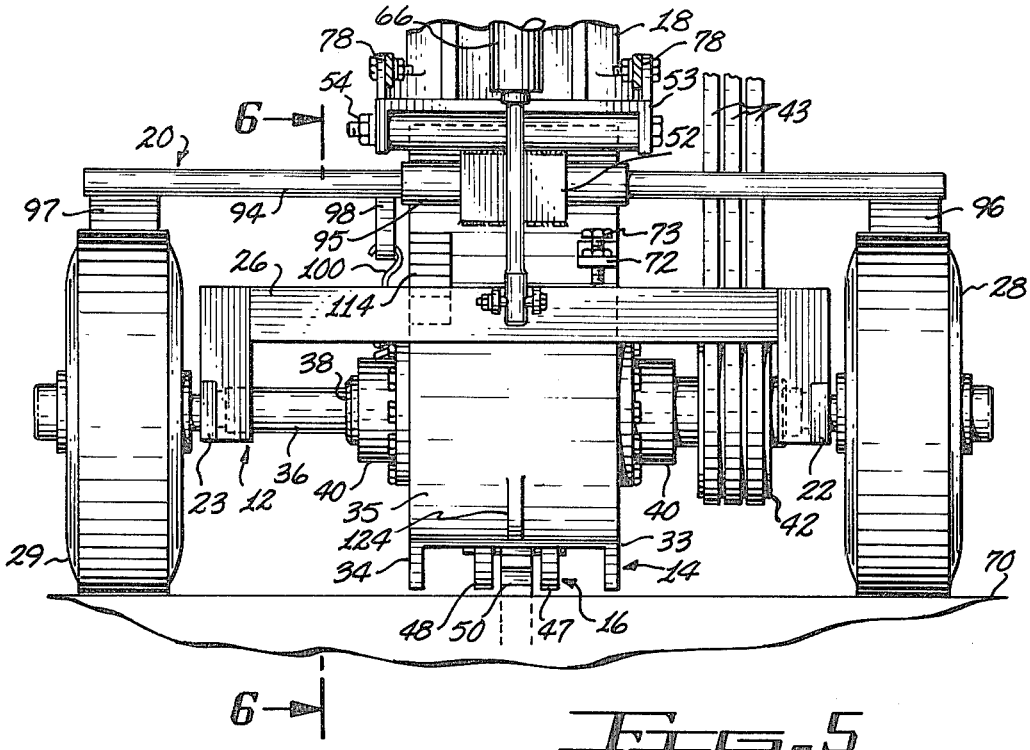
FIG. 5 is a fragmentary rear elevational view of the machine of the present invention.

As seen best in FIGS. 1, 3 and 4, the handle 21 of the machine 10 has its lower ends attached to the shroud 14, such as with bolts 76 (one shown in FIG. 4) and extends rearwardly, angularly and upwardly therefrom. The angular disposition of the handle 21 is adjustable to suit operators of various heights and such adjustment is accomplished by means of a pair of links 78 which extend rearwardly from the platform 53 and are adjustably coupled to the handle in a suitable manner.

The handle 21 includes a spaced pair of support bars 80 and 81 having a handle grip bar 82 transversely affixed to its extending end. A control panel 84 is provided on the handle 21, with the panel providing means for supporting the usual control mechanisms such as an engine start button 85, engine choke 86, engine throttle 87, and also includes means for supporting a brake adjusting device 88 as will hereinafter be described in detail. The handle grip 82 is provided with a switch 89 on one of its ends for operation of the linear actuator 66, and a dead man switch 90 is provided on the other end of the handle grip bar 82 so that the engine 18 will be automatically shut off when an operator releases his grip on the handle.

As seen best in FIGS. 1, 2, 5 and 6, the adjustable automatic brake assembly 20 includes an elongated rod 94 which is rotatably carried in a tubular sleeve 95 that is affixed to the shroud 14 such as by welding. The rod 94 is disposed transversely of the shroud 14 and has a pair of brake shoes 96 and 97 affixed to extend normally from the opposite ends thereof. The rod 94 is preferably located at the rearwardly disposed portion of the shroud 14 at a point which places the rod above the tops of the carriage wheels 28 and 29, with the brake shoes extending forwardly, angularly and downwardly into engagement with the tops of the carriage wheels.

Figure 6:
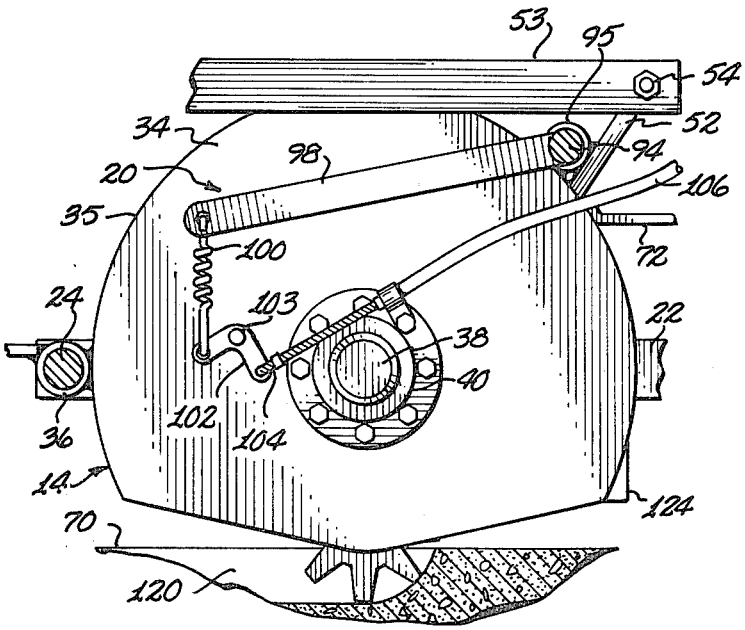
FIG. 6 is a fragmentary sectional view taken along the line 6—6 of FIG. 5.

Referring particularly to FIG. 6, wherein it will be seen that the brake assembly 20 further includes a biasing means in the form of a forwardly, angularly and downwardly extending lever 98 which is fixedly attached to the elongated rod 94 so as to extend therefrom adjacent the side plate 34 of the shroud, and the free, or extending end of the lever 98 is coupled by means of a tension spring 100 to a tension adjusting means carried on the plate 34. It will be understood that the tension adjusting means can be any suitable device, such as a bracket (not shown) which threadingly carries an adjustable bolt (not shown) that is connected to the spring. However, the preferred form of tension adjusting means is a bell crank 102 which is pivotably attached by a suitable pivot pin 103 to the side plate 34 of the shroud 14. One end of the tension spring 100 is connected to the lever 98, as described above, and the other end of the spring is connected to one leg of the bell crank 102. The other leg of the bell crank 102 has one end of a cable 104 attached thereto with the cable being slidably movable in a shield 106. The cable and shield are part of a conventional well known type of control cable assembly commonly referred to as a positive locking cable assembly. As seen in FIG. 1, and as hereinbefore mentioned, the control panel 84 has the brake adjusting device 88 mounted thereon, which will now be understood to be in the form of a rotatably lockable pull knob which is connected to the other end of the control cable 104. As is known, in one position of the pull knob 88, the cable 104 will be free to slide in the shield 106 and such sliding is accomplished by pushing or pulling the knob. When the knob 88 is rotated approximately 90° from its free position as described above, it will be locked against pushing and/or pulling movements.

It will now be seen that the brake lever 98 is biased downwardly by the tension spring 100 with the biasing force urging the rod 94 to totate about its longitudinal axis so that the brake shoes 96 and 97 will bear downwardly on the carriage wheels 28 and 29. The brake adjusting device which, as described above, includes the pull knob 88, cable 104, and bell crank 102, is provided so that the biasing force applied by the tension spring 100 can be adjusted to suit operator preferences and other variables such as pavement hardness, and the like.

The brake assembly 20, in addition to being adjustable as described above, is also automatic in that it will apply more or less braking force in accordance with the pivoted position of the shroud 14. This automatic braking feature will be understood upon consideration of the fact that the spaced height relationship between the brake rod and the tops of the carriage wheels 28 and 29 will change when the shroud is pivotably moved relative to the carriage 12. Therefore, when the shroud is moved downwardly, the rod 94 will move down and rotate about its longitudinal axis due to the engagement of the brake shoes with the carriage wheels, and such movement will cause the rod 94 and the lever 98 to rotate against the tension applied by the tension spring 100. Thus, braking force will automatically be increased when the machine 10 is making a deep cut in the pavement and will automatically be decreased when relatively shallow cuts are being made.

The usual practice followed in opening and cleaning expansion joints and random cracks in pavement is to cut the pavement to a depth of about three-quarters of an inch. Setting prior art machines to make a cut of the proper depth has always been a more or less hit or miss proposition in that depth gages which compensate for cutter wheel wear have heretofore been nonexistent to the best of our knowledge.

Figure 7:
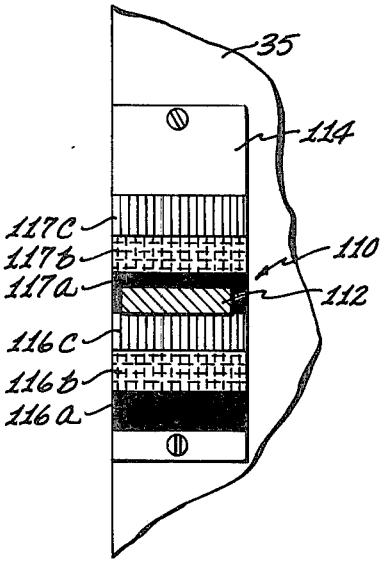
FIG. 7 is an enlarged fragmentary sectional view taken along the line 7—7 of FIG. 3.

Therefore, the machine 10 is equipped with a wear compensating depth gage 110 which, as shown in FIGS. 3 and 7, includes a pointer 112 extending from the rear cross member 26 of the carriage 12 toward a depth scale plate 114 carried on the arcuate plate 35 of the shroud 14. The depth scale plate 114 is divided into a lower group of three segments 116*a*, 116*b* and 116*c*, and an upper group of three segments 117*a*, 117*b* and 117*c*. For segment matching purposes, as will hereinafter be described in detail, segment 116*a* of the lower group is identified so as to match the lower segment 117*a* of the upper group, segment 116*b* matches segment 117*b*, and segment 116*c* matches segment 117*c*. Such matching identification can be accomplished in any convenient manner, such as by employing suitable alphamerics (not shown), and the like. However, it is preferred that a color coding technique be employed. Thus, for example, segments 116*a* and 117*a* may be colored black, segments 116*b* and 117*b* may be colored gold, and segments 116*c* and 117*c* can be colored red.

The lowermost group of segments, 116*a*, 116*b* and 116*c*, are employed for establishing a reference or starting point, and the uppermost group of segments 117*a*, 117*b* and 117*c*, are employed to set the depth of cut relative to the established reference point. For example, when the cutting elements 50 are new, i.e., have little or no wear, and the shroud is lowered until the cutting elements 50 come into contact with the paved surface 70, the pointer 112 will align with the segment 116*a*. Thus, the reference point is now known to be the segment 116*a* and the shroud is then lowered further until the pointer comes into alignment with the matching segment 117*a*, and such lowering will place the cutting elements 50 at a location where they will cut at the desired depth of three-quarters of an inch. As the cutting elements 50 wear down, as will occur in normal usage, the above described point of reference will change. Thus, progressive wear of the elements 50 will change the reference point from segment 116*a* through 116*b* and ultimately into segment 116*c*, and as the reference point progresses through the segments 116*a*, 116*b* and 116*c*, the depth setting points correspondingly progress through the segments 117*a*, 117*b* and 117*c*.

In view of the above description, a clear understanding of the machine 10 is believed to be apparent. However, to insure a complete understanding of the machine's operation, a brief description thereof will now be given.

With the engine running, the operator will first set the depth of cut by following the above described procedure relating to the depth gage 110 which will lower the shroud into its working position and the cutting wheel 16 will open a joint or random crack such as shown at 120 in FIG. 3. When the cutting elements 50 are working in the joint or crack 120 they will bite into the pavement 70 which, in conjunction with frictional engagement of the elements 50 with the joint or crack 120, will propel the machine 10 rearwardly toward the operator. In most instances the brake assembly 20 will automatically keep this inherent rearward propulsion under control, however, the brake assembly 20 can be adjusted by the operator to increase or decrease the propulsion rate to suit his preferences. Thus, it will now be apparent that the machine 10 is intended to be self-propelled in the direction of the operator, and with the brake assembly properly set, all that an operator must do is guide the machine.

The machine 10 is especially designed to facilitate operator guidance thereof. The rear cross rail 26 of the carriage 12 is upwardly offset so as not to obstruct the operator's view of a pointer 124 mounted centrally on the lower rearmost edge of the shroud 14. By placing this pointer 124 so that it aligns with the intended path of travel, the machine will cut the crack or joint 120 as intended. Further, the particular configuration and relationships between the cutter wheel 16 and the carriage wheels 28 and 29, as hereinbefore described, allows precision maneuvering of the machine 10 so that it can be made to track the most intricate path of a random crack.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What we claim is:

1. A pavement cutting machine comprising:
(a) a carriage of open configuration having a pair of spaced side rails, a rear cross rail and a front cross bar;
(b) a pair of axially aligned wheels each attached to a different one of the side rails of said carriage intermediate the front and rear ends thereof;
(c) a downwardly opening shroud having its front end pivotably coupled to the front cross bar of said carriage and disposed to lie in a central location intermediate the side rails thereof;
(d) cutter wheel means rotatably journaled in said shroud so as to lie in a central location intermediate said pair of wheels with its axis of rotation possible through the axis of said pair of wheels when said shroud pivotably moved;
(e) linear actuator means having one of its ends coupled to said shroud and having its other end coupled to the rear cross rail of said carriage and actuatable for pivotably moving said shroud to lower said cutter wheel means into a pavement cutting position below said carriage;
(f) an engine mounted on top of said shroud for movement therewith; and
(g) drive means connected between said engine and said cutter wheel means for rotatable driving thereof.

2. A pavement cutting machine as claimed in claim 1 and further comprising brake means mounted on said shroud for movement therewith and extending therefrom into engagement with at least one of said pair of wheels, said brake means biased to exert a braking force on said one of said pair of wheels and movable relative to said shroud to increase the braking force exerted thereby when said shroud is moved to lower said cutter wheel means to the cutting position thereof.

3. A pavement cutting machine as claimed in claim 1 and further comprising:
(a) an elongated brake rod mounted on said shroud so as to extend oppositely therefrom with its ends disposed adjacent different ones of said pair of wheels, said brake rod parallel with the axis of said pair of wheels and rotatably mounted about its longitudinal axis;
(b) a pair of brake shoes each affixed to a different end of said brake rod and extending normally from said brake rod into engagement with the tops of said pair of wheels;
(c) biasing means coupled between said shroud and said brake rod for rotatably urging said brake rod to cause said brake shoes to exert a braking force on said pair of wheels; and
(d) said brake rod movable with said shroud so that when said shroud is moved to lower said cutter wheel means into its cutting position said brake rod will be rotated about its longitudinal axis to increase the braking force applied by said brake shoes on said wheels.

4. A pavement cutting machine as claimed in claim 3 wherein said biasing means comprises:
(a) a lever affixed to said brake rod so as to extend normally therefrom adjacent said shroud;
(b) a tension spring having one of its ends coupled to the extending end of said lever; and
(c) adjustment means on said shroud and connected to the other end of said tension spring for adjusting the tension of said spring.

5. A pavement cutting machine as claimed in claim 4 wherein a said adjustment means comprises:
(a) a bell crank pivotably mounted on said shroud and having one of its legs coupled to the other end of said tension spring; and
(b) cable means coupled to the other leg of said bell crank and extending therefrom for remotely controlling the pivotal position of said bell crank.

6. A pavement cutting machine as claimed in claim 1 and further comprising an adjustable stop means on said shroud and extending therefrom for engagement with the rear cross rail of said carriage for limiting the pivotal movement of said shroud in the direction which lowers said cutter wheel means into the pavement cutting position thereof.

7. A pavement cutting machine as claimed in claim 1 and further comprising:
(a) a handle means mounted on said shroud and extending therefrom rearwardly of said carriage for rearward pulling of said carriage;
(b) a pointer affixed centrally of the lowermost rear edge of said shroud for guiding purposes; and
(c) said rear cross rail of said carriage being upwardly offset to provide an unobstructed view of the lowermost rear edge of said shroud and of said pointer.

8. A pavement cutting machine as claimed in claim 1 and further comprising a wear compensating depth gage means on said carriage and on said shroud for indicating the movement of said shroud needed to lower said cutter wheel means from a point in contact with the surface of the pavement to be cut to a desired cutting depth.

9. A pavement cutting machine as claimed in claim 8 wherein said wear compensating gage means comprises:
(a) a pointer extending from said carriage toward said shroud; and
(b) a depth scale plate on said shroud and movable therewith in a path past said pointer, said depth scale plate including,
I. a lower group of individually identified segments progressively arranged on said plate so that one of said segments will align with said pointer when said shroud is moved to lower said cutter wheel means into contact with the surface of the pavement to be cut with the particular one of said segments being determined by wear of said cutter wheel means, and
II. an upper group of segments progressively arranged above said lower group and matching the arrangement and identification thereof to provide each of said lower segments with a matching segment in said upper group so that movement of said shroud from where said pointer aligns with one of said lower segments to where said pointer aligns with its matching one of said upper segments will lower said cutter wheel means to a predetermined pavement cutting depth.

10. A pavement cutting machine as claimed in claim 1 and further comprising means for adjustably mounting said engine on said shroud for adjusting the tension of said drive means.

11. A pavement cutting machine as claimed in claim 10 wherein said means for adjustably mounting said engine on said shroud comprises:

(a) an engine platform pivotably mounted on one of its ends to said shroud and having said engine mounted thereon; and (b) an adjustable bolt means extending upwardly from said shroud into engagement with the other end of said engine platform for adjusting the pivotal position of said platform.

* * * * *